US009016217B2

(12) United States Patent
Vaughan

(10) Patent No.: US 9,016,217 B2
(45) Date of Patent: Apr. 28, 2015

(54) METHODS AND DEVICES FOR CONTROLLING A TUFTING MACHINE FOR FORMING CARPET WITH ENHANCED SEAMS

(75) Inventor: Neil Vaughan, Rydal, GA (US)

(73) Assignee: Columbia Insurance Company, Omaha, NE (US)

( * ) Notice: Subject to any disclaimer, the term of this patent is extended or adjusted under 35 U.S.C. 154(b) by 520 days.

(21) Appl. No.: 13/571,108

(22) Filed: Aug. 9, 2012

(65) Prior Publication Data

US 2013/0047904 A1 Feb. 28, 2013

Related U.S. Application Data

(60) Provisional application No. 61/521,613, filed on Aug. 9, 2011.

(51) Int. Cl.
*D05C 15/26* (2006.01)
*D05B 19/10* (2006.01)

(52) U.S. Cl.
CPC ..... *D05C 15/26* (2013.01); *D05B 19/10* (2013.01)

(58) Field of Classification Search
CPC ..... D05B 19/00; D05B 19/02; D05B 19/04; D05B 19/10; D05B 19/12; D05B 19/14; D05B 19/16; D05C 15/00; D05C 15/04; D05C 15/26; D05C 15/28; D05C 15/30; D05C 15/32; D05C 15/34; D05C 15/36
USPC ..... 112/80.23; 700/136, 137
See application file for complete search history.

(56) References Cited

U.S. PATENT DOCUMENTS

| | | | | |
|---|---|---|---|---|
| 3,865,059 | A | 2/1975 | Jackson | 112/79 |
| 4,217,837 | A | 8/1980 | Beasley et al. | 112/79 |
| 4,557,208 | A | 12/1985 | Ingram et al. | 112/266.2 |
| 4,800,828 | A | 1/1989 | Watkins | 112/80.41 |
| 4,815,403 | A | 3/1989 | Card et al. | 112/80.51 |
| 5,005,498 | A * | 4/1991 | Taylor et al. | 112/80.32 |
| 5,058,518 | A | 10/1991 | Card et al. | 112/266.2 |
| 5,109,784 | A * | 5/1992 | Lepe-Cisneros | 112/475.23 |
| 5,461,996 | A * | 10/1995 | Kaju | 112/80.3 |
| 5,499,588 | A | 3/1996 | Card et al. | 112/80.41 |
| 5,544,605 | A | 8/1996 | Frost | 112/475.23 |
| 5,575,228 | A | 11/1996 | Padgett et al. | 112/80.41 |
| 5,706,744 | A | 1/1998 | Card et al. | 112/80.41 |
| 5,738,030 | A * | 4/1998 | Ok | 112/475.23 |
| 5,925,434 | A | 7/1999 | Phillips et al. | 428/95 |
| 5,979,344 | A | 11/1999 | Christman | 112/80.23 |
| 6,014,937 | A | 1/2000 | Lovelady | 112/80.41 |
| 6,228,460 | B1 | 5/2001 | Hamilton et al. | 428/88 |
| 6,890,615 | B2 | 5/2005 | Horwich et al. | 428/89 |
| 7,814,850 | B2 | 10/2010 | Bearden | 112/80.4 |
| 2002/0108550 | A1 * | 8/2002 | Segars et al. | 112/80.32 |
| 2004/0202815 | A1 | 10/2004 | Horwich et al. | 428/88 |

(Continued)

FOREIGN PATENT DOCUMENTS

| | | |
|---|---|---|
| CA | 2164311 | 7/2002 |
| EP | 0701638 | 3/1996 |

(Continued)

*Primary Examiner* — Nathan Durham
(74) *Attorney, Agent, or Firm* — Ballard Spahr LLP

(57) ABSTRACT

A carpet and method for producing same that comprises an enhanced seam suitable for separation of an installation portion of the carpet and sacrificial edge portions of the produced carpet.

32 Claims, 4 Drawing Sheets

(56) References Cited

U.S. PATENT DOCUMENTS

| | | | | |
|---|---|---|---|---|
| 2007/0200286 | A1 | 8/2007 | Hillenbrand et al. | 271/204 |
| 2008/0210146 | A1 | 9/2008 | Hall | 112/80.01 |
| 2009/0101051 | A1 | 4/2009 | Christman, Jr. | 112/80.23 |
| 2009/0220728 | A1* | 9/2009 | Hall et al. | 112/80.41 |
| 2009/0260554 | A1 | 10/2009 | Hall et al. | 112/80.4 |
| 2010/0263504 | A1 | 10/2010 | Rippert et al. | 83/13 |
| 2011/0171435 | A1* | 7/2011 | Sheldon et al. | 112/475.08 |

FOREIGN PATENT DOCUMENTS

| | | |
|---|---|---|
| JP | 05247829 | 9/1993 |
| WO | WO 94/28225 | 12/1994 |
| WO | WO 95/06152 | 3/1995 |
| WO | WO 2004/092469 | 10/2004 |

* cited by examiner

METHODS AND DEVICES FOR CONTROLLING A TUFTING MACHINE FOR FORMING CARPET WITH ENHANCED SEAMS

BACKGROUND OF THE INVENTION

The invention relates in general to carpet manufactured with tufting machinery. More particularly, the invention relates to carpet production techniques for production of carpet having enhanced seaming characteristics for ease of trimming and for joining carpets together and forming a seam there between.

FIELD OF THE INVENTION

A tufting machine produces the fibrous face of tufted articles, for example carpets, by tufting individual yarns through a primary backing material or substrate, as known. The tufting machine has a frame supporting at least one elongate needle bar on which at least one series of spaced tufting needles is disposed. A continuous web of backing material is continuously fed in a warp, i.e., a longitudinal or lengthwise, feeding direction through the tufting machine during the tufting process. Each of the tufting needles is threaded with a suitable yarn to be tufted in the backing material, and the needles are passed together through the backing material by the reciprocating motion of the needle bar as the backing material is moved or carried past the needle bar during machine operation to form tufts in the "face" of the backing material. If so desired, and as known, the tufting machine may be provided with two spaced and parallel needle bars, typically a "front bar" and a "back bar" relative to the warp feeding direction of the backing material, each of which being provided with a separate series of spaced tufting needles.

The needle bar is driven through a suitable drive arrangement such that it is reciprocated vertically with respect to the backing material as it is passed beneath the needle bar during a continuous tufting operation. As appropriate, a looper or a looper and a knife may be placed on the face side of the backing material, in registry with each respective needle, so that loops or cut piles of tufted yarn are formed and remain in the backing material once the tufting needles are drawn by the needle bar back out of the backing material.

One known type of tufting machine is referred to as an "in-line" type of tufting machine, in which the respective tufting needles disposed on the needle bar are aligned with respect to one another along a common longitudinal axis. It is also known to those skilled in the tufting arts to use two separate needle bars where a separate row of in-line tufting needles is disposed on each needle bar along separate longitudinal axes, respectively. In this arrangement, the longitudinal axes of the two respective rows of tufting needles are parallel to one another and are spaced apart a predetermined distance. Additionally, it is known to align tufting needles of the two respective series or rows of tufting needles with one another in the warp or lengthwise feeding direction of the backing material. In one example, for example and because of the aligned nature of the needles of the respective rows, for a 1/10 gauge tufting machine, i.e., a tufting machine in which there are ten tufting needles per lengthwise inch of the needle bar(s), there will be two rows of 1/10 gauge needles, which together comprise a 1/20 gauge fine line tufting machine. In another example, 1/12 gauge means there are twelve needles per lengthwise inch of the needle bar. If a carpet being tufted is twelve feet wide on such a one-twelfth gauge machine, there are one thousand seven hundred twenty-eight needles across the formed width of the carpet.

Patterns can be desirably and repeatedly formed in carpets in various ways such as by using yarn textures (e.g., loop, sheared loop, cut), yarn color, pile height, and combinations of the above. With the use of controlled yarn feed systems, such as, for example and without limitation, servo-motors and/or pneumatic valve actuated gears, manufacturers are able to create patterns with pile height variation, which can allow for the production of patterned carpet without shifting the needle bars thereby allowing yarn to be tufted into the backing material in straight lines or rows.

A problem in using this type of tufting machine, in which the respective tufting needles of the two respective series or rows of tufting needles are aligned with respect to one another in the warp or lengthwise feeding direction of the backing material, is that pattern and texture problems associated with the in-line, i.e., the spaced and parallel, rows of tufts formed by the tufting needles become quiet evident in the face of the tufted article. This is especially noticeable on the respective side edge of the web of backing material as it passes through the tufting machine. This is a result of the web warping inwardly at the respective edges of the backing caused by the interaction of the engagement of the tufting needles with the backing. The inward web warping causes the back row of the tufting needles to be slightly offset with respect to the tufts formed by the front row of needles, which results in a distinct and undesirable loss of the desired "in-line" look of the carpet being tufting in a conventional in-line tufting machine. The flawed outer edge areas of the griege good must then be removed as waste materials.

The formed flawed edges are undesired due to waste and due to the desirability to join two or more broadloom sheets of carpet along a common seam in order to cover a desired area. Conventionally, the final tufting width of the produced carpet would be some dimension greater than the installed carpet width and conventionally manufacturers usually "tuft-in" extra ends (i.e., rows) of yarn along each edge of the patterned carpet to permit installers to trim back the edges to form a good quality seam between the sheets of carpet. Installers must carefully identify where the last pattern repeat falls near the trim edge of the carpet and then cut the carpet between ends of yarn to get the pattern to match at seams on the face of the carpet. Trimming the carpet can be time-consuming and wasteful, since it is often difficult to identify exactly where a pattern repeats. If the trimming is performed between the wrong rows or partially along a desired portion of the carpet, there can be a mismatch in either the pattern or a discernable seam when the two sheets of carpet are joined together. Furthermore, once an installer locates the rows of yarn to cut between, it can be difficult to cut between the rows of yarn because the rows are close together. As one will appreciate, this is especially true on tufting equipment with gauges ranging from 1/10 to 1/20 gauge, which is typical fine gauge tufting equipment.

What is needed, therefore, is an improved carpet production methodologies for use with dual needle bar tufting machines in which the needle bars may be laterally fixed or capable of being shifted that will minimize the prospect of the aforementioned pattern and/or texture problems resulting in carpet having enhance seaming characteristics.

SUMMARY OF THE INVENTION

The present invention overcomes some of the design deficiencies of the known art by controlling a conventional tufting machine dual needle bar tufting machines in which the needle bars may be laterally fixed or capable of being shifted for creating a carpet piece that has a readily discernable seam suitable for trimming without leaving a void or using a different color identification yarn.

In one embodiment, the carpet production can accomplished by controlling a conventional tufting machine having a frame, a bed rail supported on the frame, a continuous web of backing material passed over the bed rail and through the tufting machine in a warp or machine feeding direction, and at least one drive roll for moving the web of backing material through the tufting machine along the warp direction. In one aspect, the respective front and back elongate needle bars are positioned on the machine frame for reciprocating the needle bar toward and away from the backing material. Each of the needle bars has a midpoint and a pair of opposed outer ends.

In one aspect, each of the plurality of needles on the respective front and back needle bars are spaced from adjacent needles along a longitudinal axis that extends along the lengthwise dimension of each needle bar. In this aspect, each needle spaced from an adjacent needle at a consistent desired gauge distance. Further, it is contemplated that the longitudinal axis of the front needle bar is positioned substantially parallel to and forward of the longitudinal axis of the back needle bar relative to the feeding direction of the tufting machine.

In another aspect, the tufting machine further comprises a first plurality of loopers configured to operatively engage the plurality of needles of the front needle bar and a second plurality of loopers configured to operatively engage the plurality of needles of the back needle bar.

In one aspect, the tufting machine can be controlled to form an additional column of yarn incorporated into the edge portion of the carpet production piece that is spaced a desired distance from the immediately proximate interior row (the first interior row) of the carpet production piece and that extends substantially parallel to the warp direction. In this aspect, it is contemplated that the desired distance is greater than the distance between the first interior row of the carpet production piece and the row of yarn that is positioned immediately proximate and interior to the first interior row of the carpet production piece. This methodology can create an enhanced seam suitable for cutting/trimming without leaving a void or using a differed colored yarn and can created an enhanced seam regardless of pile height pattern or if the pattern is a shifted pattern.

Other apparatus, methods, and aspects and advantages of the invention will be discussed with reference to the Figures and to the detailed description of the preferred embodiments.

BRIEF DESCRIPTION OF THE DRAWINGS

The accompanying drawings, which are incorporated in and constitute a part of this specification, illustrate several aspects described below and together with the description, serve to explain the principles of the invention. Like numbers represent the same elements throughout the figures.

DETAILED DESCRIPTION OF THE INVENTION

Figure 1:
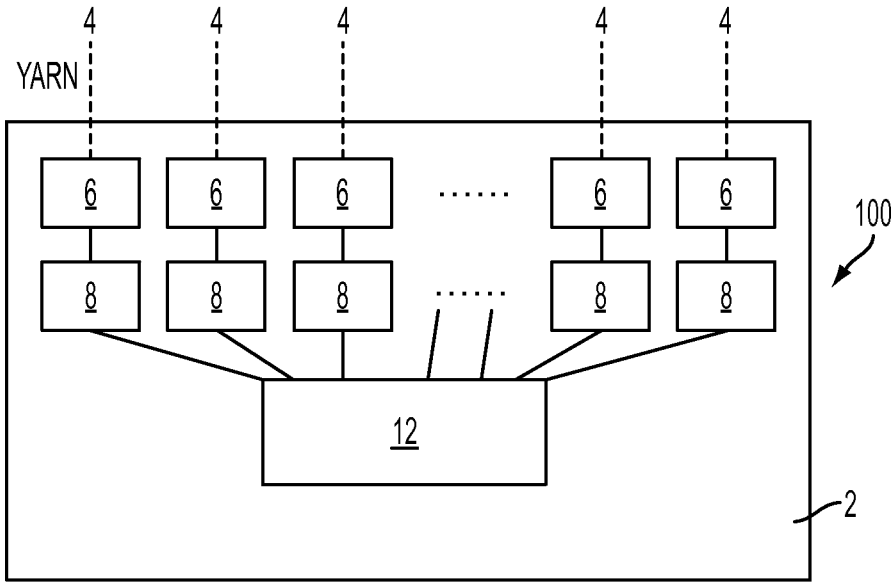
FIG. 1 is a schematic view of the control system for a tufting machine in accordance with one embodiment of this invention, the control system showing a source of yarns in communication with a plurality of yarn feed motors and a coupled plurality yarn feed controllers. A system controller is in communication with the plurality yarn feed controllers to effect control of the plurality of yarn feed motors.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a tufting needle" can include two or more such tufting needles unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

In various aspects and as used throughout, "carpet backing" can be selected from a variety of materials such as, for example and without limitation, a woven fabric, non-woven fabric, mesh, polypropylene fabric, fiberglass, polyester, jute, and the like, and/or any combination thereof.

As used throughout, the terms "tuft", "tufting", "tufted", "tufted-in", and other verb tenses thereof refer to inserting, pressing, passing, and/or any other conventional process by which yarn is attached or otherwise coupled to the carpet backing.

As used throughout, the term "carpet yarn" refers to yarn tufted into the installation portion of a production carpet piece. The "installation portion" of a carpet refers to that portion that is intended to be installed (e.g., after removal of the sacrificial edge portions). The term "trim yarn" refers to yarn tufted into the sacrificial end portions, which are typically cut off before installation of the carpet in the desired final location. Hereinafter, in one embodiment, a "row" is considered a selected path formed by yarn that extends generally in a weft direction, i.e., substantially transverse to the warp or machine direction. Further, a "column" is consider a selected path formed by yarn that extends generally in the warp direction.

In one embodiment, the invention relates to a tufting machine 2 for forming tufted carpet. In one aspect, the tufting machine forms tufted carpet on a backing material 50 moving in a warp direction, i.e., a longitudinal or lengthwise machine direction, through the tufting machine during the tufting operation. In another aspect, the backing material can have a top surface 52. In one aspect, the tufting machine comprises means for inserting loops of yarn into the backing material. In this aspect, the loops of yarn can be inserted into the backing material to form sequential substantially linear rows of yarn tufts thereon the backing material. It is contemplated that the sequential substantially linear rows R of yarn tufts thereon the backing material can be substantially transverse to the machine direction, i.e., can be in the weft direction. It is further contemplated that the sequential substantially linear rows of yarn tufts thereon the backing material are spaced substantially equally apart in the machine direction.

In another aspect, the means for inserting loops of yarn into the backing material can comprise a needle bar having a plurality of needles mounted thereon. In still another aspect, the means for inserting loops of yarn into the backing material can comprise a plurality of needles carrying a plurality of yarns into the backing material as the backing material passes through the tufting machine at a desired rate. In another aspect, the means for inserting loops of yarn into the backing material can further comprise a series of loopers adapted to engage the needles for forming loop pile tufts. For example and without limitation, exemplary loopers can comprise a plurality of loop pile loopers, cut pile hooks, level cut/loop loopers, cut/loop loopers or combinations thereof. As one having ordinary skill in the pertinent art will appreciate, any means known in the art for inserting loops of yarn into a carpet backing can be used to insert loops of yarn into the backing material.

In another aspect, a portion of each yarn tuft can project therefrom the top surface of the backing material a predetermined height. In still another aspect, each yarn tuft can project therefrom the top surface of the backing material a predetermined height such that a pattern or a desired appearance is formed on the face of the carpet. For example, the predetermined height can vary or be substantially the same from tuft to tuft so that a pattern is formed on the face of the carpet. In yet another aspect, each yarn tuft can be a cut pile tuft, a loop tuft, or any variation thereof.

In one aspect, and as exemplarily and schematically shown in FIG. 1, a control system 100 for a tufting machine 2 for forming patterned tufted articles is provided. In another aspect, the control system can comprise at least one of a source of yarns 4, a plurality of yarn feed motors 6, a plurality of yarn feed controllers 8, and a system controller 12 in communication with the tufting machine. As one skilled in the art will appreciate, such a tufting machine in communication with at least one of a source of yarns, a plurality of yarn feed motors, a plurality of yarn feed controllers, and a system controller is known in the art and it is contemplate that any such conventional tufting system can be used with the process and method of the present invention.

According to one aspect, the source of yarns 4 can comprise a plurality of yarns, such as for example and without limitation, at least one creel or at least one beam. In another aspect, each yarn feed motor of the plurality of yarn feed motors 6 can be in communication with one yarn from the source of yarns and one needle of the plurality of needles of the tufting machine. In another aspect, each yarn feed controller 8 of the plurality of yarn feed controllers can be coupled to a respective yarn feed motor for controlling the amount of yarn being supplied by the respective yarn feed motor to a respective needle of the tufting machine. Thus, for each yarn of the plurality of yarns, there can be a respective yarn feed controller, a respective yarn feed motor, and a respective needle. In a further aspect, each yarn feed controller of the plurality of yarn feed controllers can provide yarn to a corresponding needle of the plurality of needles at a selectable yarn feed rate. In still a further aspect, each yarn feed controller of the plurality of yarn feed controllers can further comprise means for selectively adjusting the yarn feed rate.

In one aspect, the system controller 12 can be configured for controlling operation of the tufting machine. In another aspect, the system controller can be configured for controlling operation of the yarn feed controllers for controlling operation of the yarn feed motors. In this aspect, the control system can comprise a processor coupled to each yarn feed controller of the plurality of yarn feed controllers. In another aspect, the processor of the control system can be configured to control the respective yarn feed rate of each yarn feed controller of the plurality of yarn feed controllers in response to a predetermined yarn feed profile, described more fully below.

As one having ordinary skill in the pertinent art will appreciate, the processor can be any processing element known in the art, such as, without limitation, a personal computer or a server computer. As one having ordinary skill in the pertinent art will further appreciate, the processor can comprise any of a number of processing devices, systems or the like that are capable of operating in accordance with the embodiments of the invention. It is contemplated that the processor can be in communication with a memory that stores content, data, or the like. The memory can also store software applications, instructions, or the like for the processor to perform steps associated with varying the predetermined yarn feed profiles, as described herein. It is further contemplated that the processor can be connected to at least one interface or other means for displaying, transmitting, and/or receiving data, content, or the like. The interface can include at least one communication interface or other means for transmitting and/or receiving data, content, or the like, as well as at least one user interface that can include a display and/or a user input interface. The user input interface, in turn, can comprise any of a number of devices allowing the processor to receive data from a user, such as a keypad, a touch display, a joystick or other input device. In one aspect, the control system can be configured to signal at least one yarn feed controller of the plurality of yarn feed controllers to change its yarn feed rate to a selected yarn feed rate.

A well-known type of tufting machine needle bar design is known to those skilled in the art as a graphic needle bar, a double needle bar, or a dual needle bar design. This needle bar design has two spaced and parallel needle bars rather than a single needle bar that forms either an in-line, a staggered, or a non-staggered needle bar design. The two separate needle bars have only one row of tufting needles on each of the two needle bars. As one will appreciate, the tufting needles can be configured in either a staggered or non-staggered design. As illustrated, a plurality of tufting needles on the front needle bar lie along a front, common longitudinal axis, and the plurality of tufting needles of the back needle bar lie along a back, common longitudinal axis, which is spaced from and parallel to the front axis. The respective front and back axes are spaced a predetermined distance from each other such as, for example and not meant to be limiting, about one quarter (¼) of an inch from one another. It will be appreciated that the terms "front" and "back" are used herein to describe the relative position of the respective needles bars in relation to the feeding direction of the carpet web or substrate therethrough the tufting machine.

In one aspect, and as know in the art, the double needle bar tufting machine 2 can be configured to operate so that there is no relative (lateral) motion between the two needle bars. Optionally, however, and as known in the art, the double needle bar tufting machine can be configured such that the two needle bars can be independently shifted or moved laterally relative to each other in the weft direction of the backing material to allow for the formation of significantly more tufting patterns. Conventionally, the respective front and back needle bars are supported on the frame of the tufting machine and are configured for at least reciprocating motion with respect to the frame. Examples of graphic needle bar designs are disclosed in U.S. Pat. Nos. 4,841,886; 5,058,518; 5,193,472; 5,224,434; 5,549,064; and 6,014,937, and in UK Patent Application GB 2,255,785, respectively, each of which is incorporated herein in their entirety by this reference.

In a further aspect, and as known in the art, the tufting machine 2 on which the front and back needle bars are supported can form sequential substantially linear columns C of yarn tufts thereon the backing material that extend substantially parallel to the warp or machine direction. In this aspect, the sequential substantially linear columns of yarn tufts can spaced substantially equally apart in the weft direction in the middle portion of the backing material. However, because of the necking down tendency of the backing material proximate the outer longitudinal edge portions of the backing material that occurs with double needle bar tufting machines, it is contemplated that the sequential substantially linear columns C of yarn tufts are spaced substantially non-equally apart in the weft direction in the outer longitudinal edge portions of the backing material.

In one aspect, a methodology is provided for forming an enhanced seam 20 that suitably provides a sized gap between preselected columns of tufted yarn. In this aspect, the sized gap is configured and sized to allow for ready cutting of the carpet to the installation portion without inadvertent and undesired cutting of any tufted yarn within the installation portion. By providing the enhanced seam, an installer can readily identify and remove the sacrificial portions 210 of the production carpet piece 200, which allows for a high quality match when separate pieces of the trimmed installation portions 220 of the carpet pieces are installed side by side. This aspect of the invention permits identifying pattern repeats at the edge of a carpet to ease and speed installation of the carpet.

Figure 2:
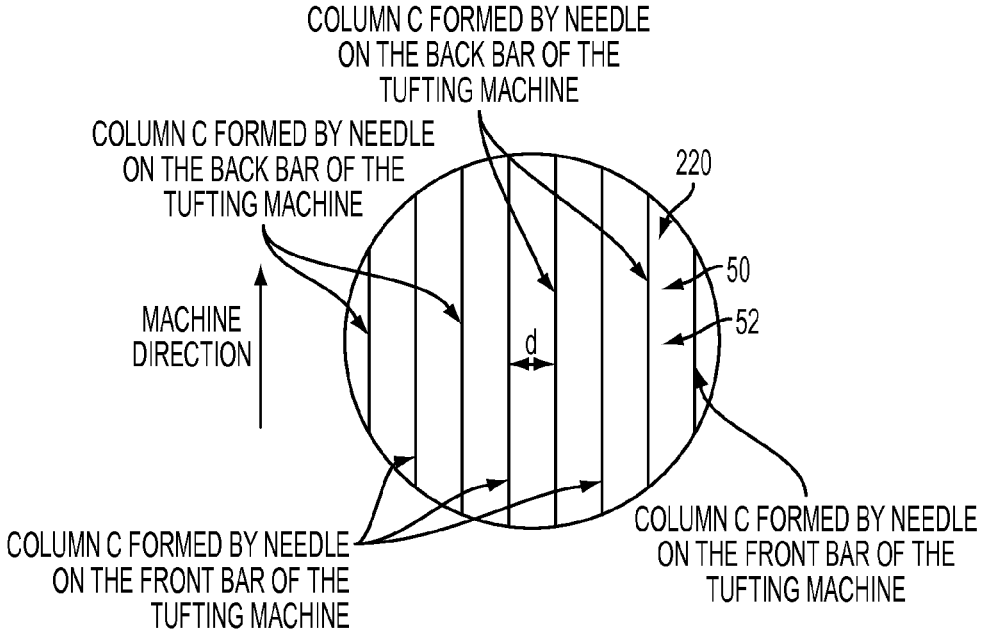
FIG. 2 is a partial schematic illustration of a middle portion of a conventional carpet piece, showing a yarn tufted by a needle mounted on a back bar of a tufting machine and a yarn tufted by needle mounted on a front bar of the tufting machine. Also shown is a substantially constant distance (d) between the yarn tufted by the needles on the front bar and the yarn tufted by the needles on the back bar is this middle portion of the carpet piece.
Figure 3:
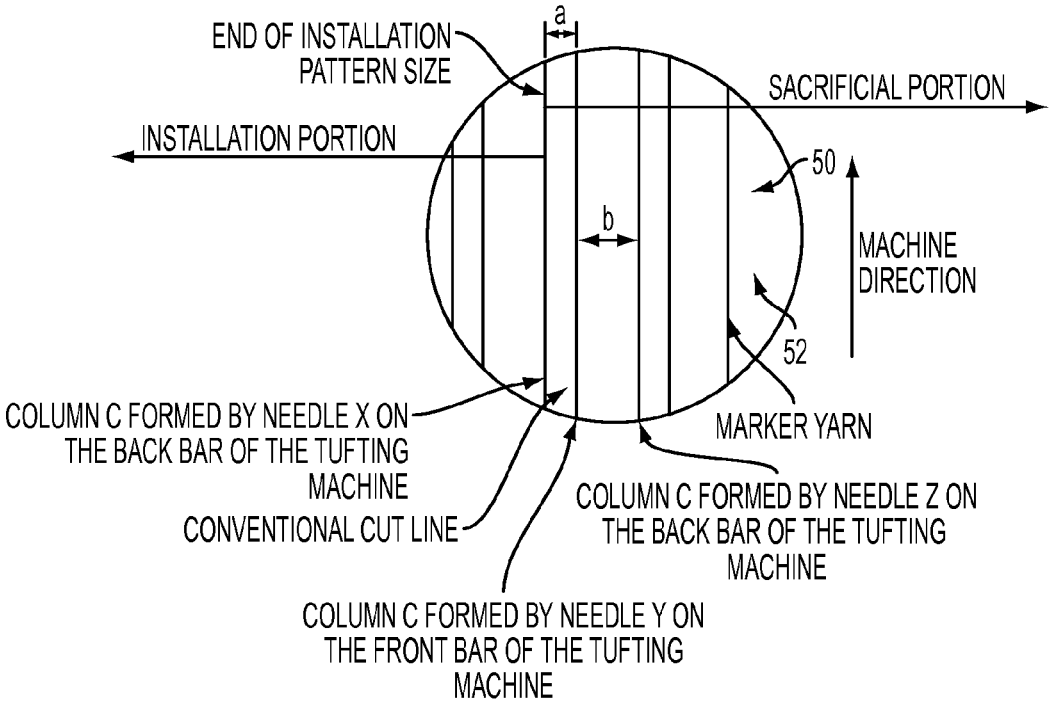
FIG. 3 is a partial schematic illustration of an operator's right side edge portion of a conventional carpet production piece, showing a yarn tufted by needle x mounted on a back bar of a tufting machine and a yarn tufted by needle y mounted on a front bar of the tufting machine. Also shown is the distance (a) between the yarn tufted by the needle y on the front bar and the yarn tufted by the needle x on the back bar and the distance (b) between yarn tufted by the needle z on the back bar and the adjacent column of yarn tufted by the needle y on the front bar. Additionally, a conventional trimming line between the yarn tufted by the needle y on the front bar and the yarn tufted by the needle x on the back bar in the distance (a) is shown.

As one skilled in the art will appreciate and as shown in FIGS. 2 and 3, a double needle bar tufting machine 2 is conventionally controlled to form a patterned tufted carpet that extends in the weft direction in accord with a predetermined pattern P in which each linear row of yarn tufts comprises a predetermined number of N stiches or tufts. In this conventional modality and as one skilled in the art will appreciate, the pattern can comprises a single pattern having N stiches or a series of repeated patterns, in which the total number of stiches in the repeated patterns is N. In the present invention, to form the readily discernible enhanced seam 20 suitable for trimming, the double needle bar tufting machine 2 of the present invention can be controlled to add a single additional column of yarn tufts. The single additional column C of yarn tufts can be formed by controlling the double needle bar tufting machine 2 to add one additional stitch as the end of the predetermined patter such that each linear row of yarn tufts comprises a predetermined number of N+1 stiches or tufts.

Figure 5:
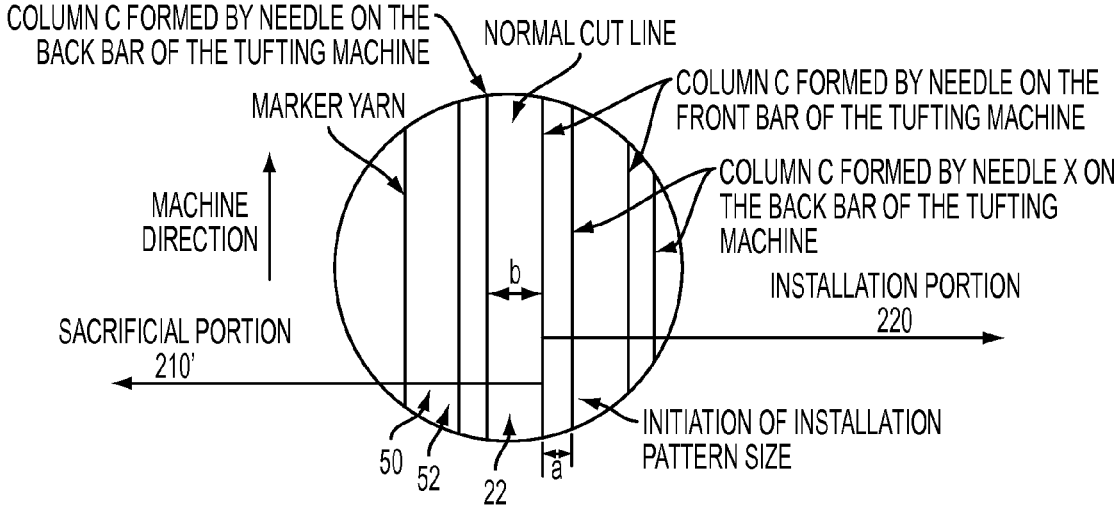
FIG. 5 is a partial schematic illustration of an operator's left side edge portion of a conventional carpet production piece, showing yarns tufted by needles mounted on a back bar of a tufting machine and yarns tufted by needles mounted on a front bar of the tufting machine. Also shown is the distance (a) between the yarn tufted by the needle on the front bar and the yarn tufted by the needle on the back bar and the distance (b) between yarn tufted by the needle on the back bar and the adjacent row of yarn tufted by the needle on the front bar. Additionally, a conventional trimming line between, from left to right in the illustration, the yarn tufted by the needle on the back bar and the yarn tufted by the needle on the front bar in the distance (b) is shown.

In one aspect, and as shown in FIG. 5, a first seam 22 suitable for trimming is defined along a left longitudinal side of the formed carpet piece 200 between the installation portion 220 of the carpet and the left sacrificial portion 210' of the carpet piece. The first seam 22 advantageously takes advantage of the necking down phenomena that conventionally occurs during the double needle bar tufting machine 2 operations. Here, the first seam 22 is identified as being between the last column of trim yarn on the left sacrificial portion 210' of the carpet piece (which is formed by a needle on the back bar of the tufting machine) and the first column of the yarn of the desired installation portion 220 (which is formed by a needle on the front bar of the tufting machine), which forms the exposed column of yarn at the left longitudinal side of the installation portion of the formed carpet piece. The first seam 22 is defined as a space having a width b that that is greater the gauge of the respective front and back needle bars and that is less than twice the gauge of the respective front and back needle bars of the double needle bar tufting machine 2.

Figure 4:
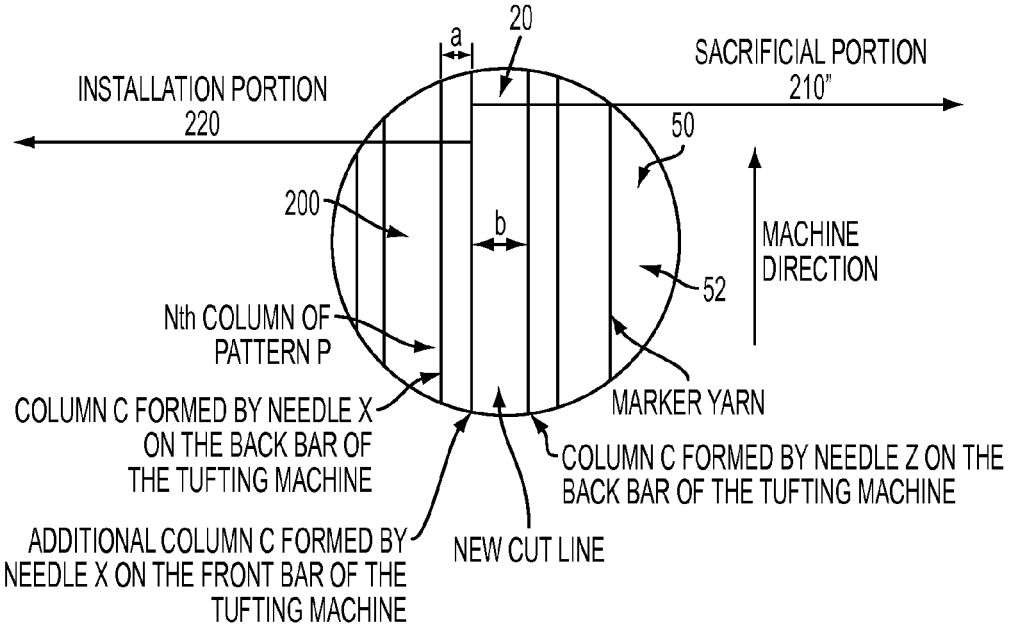
FIG. 4 is a partial schematic illustration of an operator's right side edge portion of a carpet production piece produced by the method described herein, showing a yarn tufted by needle x mounted on a back bar of a tufting machine and a yarn tufted by needle y mounted on a front bar of the tufting machine. Also shown is the distance (a) between the yarn tufted by the needle y on the front bar and the yarn tufted by the needle x on the back bar and the distance (b) between yarn tufted by the needle z on the back bar and the adjacent column of yarn tufted by the needle y on the front bar. Additionally, an enhanced trim seam between the yarn tufted by the needle y on the front bar and the yarn tufted by the needle z on the back bar in the distance (b) is shown.

In another aspect, and as shown in FIG. 4, the enhanced seam 20 suitable for trimming is defined along a right longitudinal side of the formed carpet piece 200 between the installation portion 220 of the carpet and the right sacrificial portion 210" of the carpet piece. In this aspect, an additional column of yarn is added to the installation portion 220 of the formed carpet piece (e.g., adding an additional column of yarn to the predetermined columns of yarn forming the desired installation pattern) to define suitable spacing between the added column of yarn and the immediately adjacent column of trim yarn on the right sacrificial portion 210" of the carpet piece. As one will appreciate, the additional column of yarn will form the exposed column of yarn at right longitudinal side of the installation portion 220 of the formed carpet piece, i.e., the additional column of yarn forms the last column of the installation portion of the carpet piece. Similar to the width of the first seam 22, the enhanced seam 20 is defined as a space having a width b that is greater than the gauge of the respective needle bars and is less than twice the gauge of the respective needle bars of the double needle bar tufting machine 2, which allows for the ready trimming of the sacrificial portion 210" from the installation portion 220 of the carpet as opposed to the conventional practice of cutting between two rows of yarn that are spaced very close together at a distance a. The distance b of the spaced columns of yarn defining the enhanced seam 20 is greater than the distance d between the rows in a middle portion 240 of the installation portion 220 of the carpet. Further, the distance b of the spaced columns of yarn defining the enhanced seam is greater than the distance c that a conventional carpet construction provides. As one will appreciate, for ease in description, the terms left and right are used, but it is contemplated that "left" and "right" can be used interchangeably.

In another aspect, it is contemplated that the yarn forming the added additional column of yarn can be tufted to a desired height that is below the heights of the respective adjacent tufted column in the installation portion and the sacrificial portion. In one aspect, the added additional column of yarn can be pulled low to minimize or eliminate the visual appearance of the added additional column of yarn. The term low in this context is used to refer to pulling the loops of the respective tufts below the height of the adjoining column of tufts and can refer to pulling the loops of the respective tufts down to at or proximate to the surface level of the backing surface. Optionally, it is contemplated that the yarn forming the added additional column of yarn can be pulled to a substantially uniform height, a non-uniform height, or combinations of both as desired. For example and without limitation, it is contemplated that the added additional row of yarn can be pulled to less than 0.0300 inches, less than 0.0250, less 0.0150, or less than 0.0100.

In an optionally aspect, the end of yarn forming the added additional column of yarn can be selectively controlled to be stitched into the carpet at desired select intervals along the longitudinal axis of the produced carpet piece, e.g., the end of yarn would not be stitched into the carpet in every warp row but could be spaced in the weft dimension.

In another aspect, it is contemplated that the needle forming the added additional column can have a feed rate that is less than the feed rate of respective adjacent tufted column in the installation portion and the sacrificial portion. As one would appreciate, the looper that is configured to cooperate with the needle forming the added additional column of yarn can be configured to receive yarn at a rate that is less than the rate of the respective adjacent tufted rows in the installation portion and the sacrificial portion.

It is contemplated that this process can be used to form any exemplary type of tufting machine created carpet. In one aspect, this process adds one additional column of yarn to the otherwise conventional pattern that forms the installation process and advantageously takes advantage of the necking down problem to effect the production of and identification of trimmable seams that are sized for ease in trimming the sacrificial portion of the tufted greige portion just outside the installation portion of a carpet production piece along each longitudinal edge of the carpet.

Figure 6:
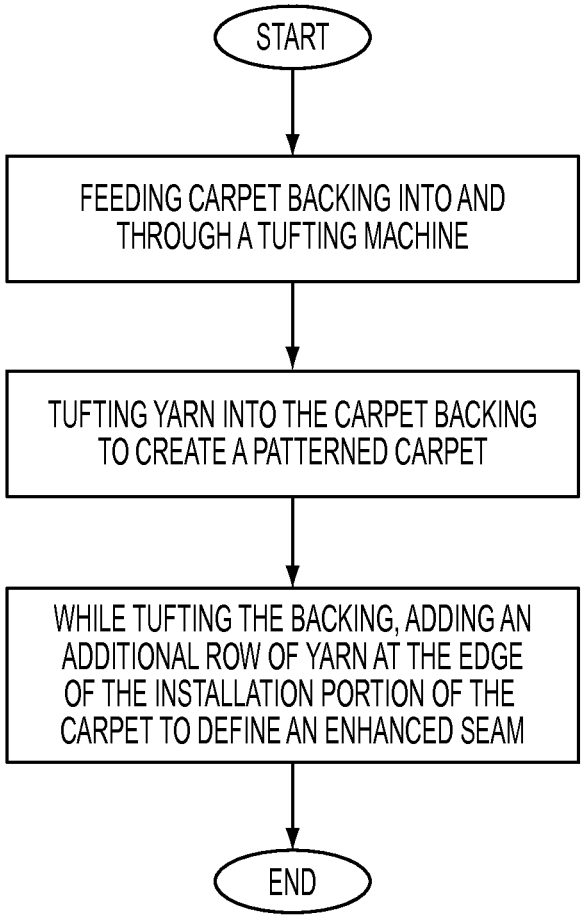
FIG. 6 illustrates one embodiment of a method of manufacturing a carpet with an enhanced trim seam.

FIG. 6 illustrates an exemplary method of manufacturing a carpet with an enhanced seam. Initially, the carpet backing is fed through the tufting machine in the machine direction and yarn may be tufted into the backing material by the plurality needles on the front and back bars of the double needle bar tufting machine 2 to create a patterned carpet. In this step, additional columns of yarn are also tufted into the carpet backing along the respective longitudinal side of the carpet to create the sacrificial portions. While tufting the yarn into the carpet backing, an enhanced seam 20 is created on one side of the carpet piece by adding an additional column of yarn to the installation portion immediately adjacent to the predetermined columns of yarn forming the desired installation pattern 220. This method defines suitable spacing b between the added column of yarn and the immediately adjacent column of trim yarn on the adjacent sacrificial portion 210 of the carpet piece. The use of the exemplary method allows for the creation of seams that are sized for easy trimming without leaving a void or using a different color yarn. This method also beneficially allows for the creation of seams regardless of pile height pattern or if the pattern is a shifted pattern. It is of course contemplated that this method can be used on both shifted and non-shifted double needle bar carpet tufting machines.

In various embodiments and for example, for a 1/12 gauge tufting machine, the sacrificial portion 210 can be one-half inch wide or six ends of yarn wide, one-inch or 12 ends of yarn wide, along the respective longitudinal edges of the carpet. Optionally, the yarn tufted the sacrificial portion 210 of the carpet can different (e.g., of a different color, pile height, texture, etc.) than the yarn tufted into installation portion 220 of the formed carpet.

In one example, a 1/12 gauge tufting machine can be used to create a carpet production piece having an enhanced seam of desired spacing. In this example, assuming a tufting backing 146 inches in width and having respective one inch sacrificial portions at each edge, the installation portion would be approximately 144 inches. This conventionally would result in an installation portion 220 being formed from 1728 columns (N ends) of yarn (12 ends/inch×144 inches) but with a trimmable seam having the undesirable width a. In accord with the method described herein, an additional row is added to the installation portion for a total number of rows equaling 1729 (N+1). The spacing b formed by this method, being far greater than distance a, is more than sufficient for skilled installers to remove the sacrificial portion 210 of the carpet without damaging the installation portion 220 of the carpet 200.

One skilled in the art will further appreciate another advantage of the present invention which is that the disclosed tufting needle assembly may be easily incorporated into existing tufting machinery. In optional aspects, it is contemplated that the tufting machine can be programmed to follow the run conditions of the tufting machine. Further, it is contemplated that the tufting machine can be configured to detect yarn location in a widthwise direction relative to select needles and/or loopers. In one aspect, the tufting machine can be configured to vary yarn feed rate to select needles based on a predetermined pattern design. It is also contemplated that the tufting machine can be programmed or otherwise configured such that the tufting machine can override the pattern feed rate when the yarn used to form the additional row is in direct interaction with the looper that cooperates with needle coupled with the yarn used to form the additional row. Optionally, and as one skilled in the art will appreciate, if the additional row of yarn is pulled low, the low additional row can be drawn into the installation portion of the carpet piece when on straight stitch and can be shifted when the pattern advance mode is on 1:1 (i.e., a main shaft mode).

Throughout this application, various publications are referenced. The disclosures of these publications in their entireties are hereby incorporated by reference into this application in order to more fully describe the state of the art to which this invention pertains.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is therefore understood that the invention is not limited to the specific embodiments disclosed herein, and that many modifications and other embodiments of the invention are intended to be included within the scope of the invention. Moreover, although specific terms are employed herein, they are used only in a generic and descriptive sense, and not for the purposes of limiting the described invention.

What is claimed is:

1. A control system for a tufting machine of the type having a plurality of needles mounted on a front needle bar and a back needle bar and a plurality of cooperating loopers for carrying a plurality of yarns into a backing material that passes through the tufting machine in a machine direction at a desired rate to form a patterned tufted carpet piece, the control system comprising:

a system controller in communication with the tufting machine for controlling operation of the tufting machine, the system controller programmable to:

enable input of a predetermined pattern that comprises N columns of yarn tufts, each column of yarn tufts in the pattern being spaced from adjacent columns and extending generally in the machine direction;

control the operation of the tufting machine to add an additional column of yarn tufts adjacent to the last column of the pattern to define an enhanced seam between an installation portion and a sacrificial portion of the carpet piece, wherein the additional column of yarn forms the last column of an installation portion of the carpet piece, and wherein the additional column of yarn is spaced in a weft direction from the last column of the pattern at a distance that is greater than a gauge of the respective front and back needle bars and less than twice the gauge of the respective front and back needle bars of the tufting machine.

2. The control system of claim 1, wherein the distance between columns of yarn tufts in a middle portion of the installation portion of the carpet piece are substantially equal.

3. The control system of claim 2, wherein the distance between columns of yarn tufts proximate the longitudinal edges of the installation portion of the carpet piece is substantially non-equal.

4. The control system of claim 2, wherein the enhanced seam is defined as a space having a width b in the weft direction.

5. The control system of claim 4, wherein the width of the spaced columns of yarn defining the enhanced seam is greater than the distance between the rows in the middle portion of the installation portion of the carpet.

6. The control system of claim 1, wherein the additional column of yarn is tufted to a desired height that is below the heights of the respective adjacent tufted columns of yarn in the installation portion and the sacrificial portion.

7. The control system of claim 1, wherein the added additional column of yarn is pulled low to minimize the visual appearance of the added additional column of yarn.

8. The control system of claim 7, wherein the added additional row of yarn is pulled to less than 0.0300 inches.

9. The control system of claim 7, wherein the added additional row of yarn is pulled to less than 0.0150 inches.

10. The control system of claim 1, wherein the additional column of yarn is pulled to a substantially uniform height, a non-uniform height, or combinations of both.

11. The control system of claim 1, wherein the additional column of yarn is selectively stitched into the carpet piece at desired select spaced intervals in the machine direction along the longitudinal axis of the carpet piece.

12. The control system of claim 11, wherein the additional column of yarn is not stitched into the carpet piece in every warp row.

13. The control system of claim 1, wherein the yarn tufted into the sacrificial portion of the carpet piece is discernibly different than the yarn tufted into the installation portion of the formed carpet piece.

14. The control system of claim 1, wherein the system controller is configured to detect yarn location in a widthwise direction relative to select needles.

15. The control system of claim 1, wherein the system controller is configured to vary yarn feed rate to select needles based on a predetermined pattern design.

16. The control system of claim 1, wherein the additional column of yarn is formed by the front needle bar.

17. A method for operating a tufting machine of the type having a plurality of needles mounted on a front needle bar and a back needle bar to form a patterned tufted carpet piece, comprising:

receiving a predetermined pattern that comprises N columns of yarn tufts;

adding an additional column of yarn tufts to the last column of the pattern to define an enhanced seam between an installation portion and a sacrificial portion of the carpet piece, wherein the additional column of yarn forms the last column of an installation portion of the carpet piece, and wherein the additional column of yarn is spaced in a weft direction from the last column of the pattern at a distance that is greater than a gauge of the respective front and back needle bars and less than twice the gauge of the respective front and back needle bars of the tufting machine;

feeding a backing material through the tufting machine in a machine direction at a desired rate; and as the backing material is fed through the tufting machine, reciprocating the plurality of needles on the front and back needle bars to carry a plurality of yarns into the backing material to form substantially parallel rows that are spaced from each other in the machine direction and substantially parallel columns that are spaced from each other in the substantially transverse weft direction.

18. The method of claim 17, wherein receiving a predetermined pattern comprises downloading or uploading a pattern into a system controller for the tufting machine.

19. The method of claim 18, wherein adding an additional column of yarn tufts comprises uploading an instruction to the system controller to add the additional column of yarn to the pattern stored in the system controller.

20. The method of claim 17, wherein receiving a predetermined pattern and adding an additional column of yarn tufts comprises downloading or uploading a control instructions into a system controller for the tufting machine.

21. The method of claim 17, further comprising engaging the plurality of yarns carried to the plurality of needles with a plurality of loop pile loopers, cut pile hooks, level cut/loop loopers, cut/loop loopers or combinations thereof, as the needles are reciprocated into and out of the backing material.

22. The method of claim 17, wherein the distance between columns of yarn tufts in a middle portion of the installation portion of the carpet piece are substantially equal.

23. The method of claim 22, wherein the distance between columns of yarn tufts proximate the longitudinal edges of the installation portion of the carpet piece are substantially non-equal.

24. The method of claim 22, wherein the enhanced seam is defined as a space having a width b in the weft direction.

25. The method of claim 24, wherein the width of the spaced columns of yarn defining the enhanced seam is greater than the distance between the rows in the middle portion of the installation portion of the carpet.

26. The method of claim 17, further comprising controlling the height of the additional column of yarn, wherein the additional column of yarn is tufted to a desired height that is below the heights of the respective adjacent tufted columns of yarn in the installation portion and the sacrificial portion.

27. The method of claim 17, further comprising pulling the additional column of yarn low to minimize the visual appearance of the added additional column of yarn.

28. The method of claim 27, wherein the added additional row of yarn is pulled to less than 0.0300 inches.

29. The method of claim 27, wherein the added additional row of yarn is pulled to less than 0.0150 inches.

30. The method of claim 17, further comprising pulling the additional column of yarn to a substantially uniform height, a non-uniform height, or combinations of both.

31. The method of claim 17, further comprising forming the additional column of yarn into the carpet piece at desired select spaced intervals in the machine direction along the longitudinal axis of the carpet piece.

32. The method of claim 31, wherein the additional column of yarn is not stitched into the carpet piece in every warp row.

* * * * *